US006957786B2

(12) United States Patent
Bratton et al.

(10) Patent No.: US 6,957,786 B2
(45) Date of Patent: Oct. 25, 2005

(54) JAW CRUSHER UNIT

(75) Inventors: Terence Bratton, Swadlincote (GB); Paul Douglas, Swadlincote (GB)

(73) Assignee: Extec Industries PLC, Derbyshire (GB)

( * ) Notice: Subject to any disclaimer, the term of this patent is extended or adjusted under 35 U.S.C. 154(b) by 435 days.

(21) Appl. No.: 10/169,593

(22) PCT Filed: Nov. 1, 2001

(86) PCT No.: PCT/GB01/04837

§ 371 (c)(1),
(2), (4) Date: Jul. 5, 2002

(87) PCT Pub. No.: WO02/36262

PCT Pub. Date: May 10, 2002

(65) Prior Publication Data

US 2003/0183707 A1 Oct. 2, 2003

(30) Foreign Application Priority Data

Nov. 4, 2000 (GB) ..... 0027172

(51) Int. Cl.[7] ..... B02C 1/10
(52) U.S. Cl. ..... 241/267; 241/300
(58) Field of Search ..... 29/426.5, 244, 29/700; 241/264–269, 30, 300

(56) References Cited

U.S. PATENT DOCUMENTS 2,453,596 A * 11/1948 Roubal ..... 241/300
3,153,512 A * 10/1964 Polzin ..... 241/300
5,323,976 A 6/1994 Johnson et al. ..... 241/286

FOREIGN PATENT DOCUMENTS

DE 2733358 2/1979
DE 4108517 9/1991

* cited by examiner

*Primary Examiner*—Mark Rosenbaum
(74) *Attorney, Agent, or Firm*—Madson & Metcalf

(57) ABSTRACT

A jaw crusher unit for use in crushing stone and other crushable material has a fixed jaw and a movable jaw which define a crushing zone therebetween. A drive mechanism coupled with the movable jaw operates to rock the movable jaw to and fro to crush material in the crushing zone. A link mechanism sets a space between the lower end of the movable jaw and the fixed jaw and thereby controls the discharge of crushed material from the lower end of the crushing zone. A removable wear plate is mounted on a mounting face of at least one of the jaws by a wedge arrangement coupled with a power-operated linear actuator. The linear actuator moves the wear place into and out of engagement with the mounting face to facilitate replacement of the wear plate.

14 Claims, 2 Drawing Sheets

JAW CRUSHER UNIT

This invention relates to a jaw crusher unit for use in crushing stone and other crushable material and comprising a fixed jaw and a movable jaw which define a crushing zone therebetween, and a drive mechanism operative to rock the movable jaw to and fro in order to crush material in the crushing zone.

The crushing zone defined between the fixed jaw and the movable jaw is usually generally convergent towards its lower discharge end, so that crushable material can be fed to the upper and wider end of the zone, and then fall downwardly under gravity while being subjected to repeated cycles of crushing movement and relieving movement of the movable jaw. This breaks down the material, and crushed material finally falls under gravity through the narrower lower discharge end of the crushing zone.

In existing machines, the drive mechanism usually takes the form of an eccentric drive mechanism, and the "throw" of the mechanism has an influence on the crushing action, and so also has the width of the crushing zone at the lower discharge end.

It is also usual to provide an adjustable link mechanism which is connected to a lower end of the movable jaw, and which can be adjusted in order to set any required spacing apart of the lower end of the movable jaw from the lower end of the fixed jaw.

It is also usual to provide removable wear plates, mounted on each of the fixed jaw and the movable jaw, and which exert a working action on the crushable material, and therefore must be robustly constructed, so as to be able to exert mechanical crushing action, and also to resist the inevitable wearing action as the wear plates engage the material. Wear plates have a working life which will depend upon the material being crushed, and as the wear plates become worn, this increases the width of the crushing zone, and therefore it is known to provide means for adjusting the spacing apart of the fixed jaw and the movable jaw, to compensate for wear. However, when the wear on one or both wear plates reaches an unacceptable level, it is then necessary to stop the operation of the jaw crusher unit, to unfasten the or each wear plate which requires replacement, to remove it, and then to install replacement wear plates.

In existing machines, it is usual to employ wedges which engage wedging recesses, or holding shoulders provided on the wear plates, and to provide bolts which engage the wedges and which, upon tightening, cause the wedges to pull the wear plates into clamped engagement with the adjacent mounting surface of the jaw on which the wear plate is mounted. Use of wedges and bolts is presently used in order to mount, and de-mount wear plates on both fixed jaws and also movable jaws.

The use of bolts and wedges does provide reliable clamping of the wear plates in position on the mounting faces of the fixed and movable jaws, but the use of threaded fasteners, such as bolts, is a time consuming operation, as far as assembly is concerned, and also gives rise to further problems upon de-mounting of worn wear plates. In the case of assembly, the operation is reasonably straightforward, in that a replacement wear plate is lowered into position, the wedges are engaged with the wear plate, and then the bolts are tightened. The only serious drawback, with regard to existing use of wedges and bolts, as far as assembly is concerned, therefore is the time consuming nature of the job, and the need to inter-fit the wedges with the wear plates. However, with regard to de-mounting of worn plates, in practice this is often a difficult task, since crusher dust and small crushed particles can become trapped or lodged between the wear plate and the jaw on which it is mounted, and also between the wear plate and adjacent parts of the crusher unit. Therefore, even although the bolts are untightened, and release the wear plates, in practice the wear plates often remain fully engaged with the mounting surfaces of the jaws, by reason of the trapped material. The frictional forces arising can be very substantial, and it is a matter of practical experience, with existing machines using bolts and wedges, that the use of usual lifting tools to attempt to lift out released wear plates is ineffective, since application of a lifting load to the wear plate merely results in the entire jaw crusher unit being lifted, which typically might be in the order of 13 tons in weight, and the application of such a lifting force is insufficient to cause the de-mounting of the wear plate from the jaw.

The present invention has therefore been developed primarily with a view to provide an improved means for effecting disengagement of a wear plate from a jaw, so that a worn plate can be easily lifted out, and such means also being capable of operating more speedily than existing bolt and wedge action, to effect mounting in position of the wear plates on the jaws (fixed jaw and/or movable jaw).

According to the invention there is provided a jaw crusher unit for use in crushing stone and other crushable material and comprising a fixed jaw and a movable jaw which define a crushing zone therebetween, a drive mechanism coupled with the movable jaw and operative to rock the movable jaw to and fro in order to crush material in the crushing zone, a link mechanism connected to a lower end of the movable jaw and serving to set any required space between the lower end of the movable jaw and the fixed jaw and thereby control the discharge of crushed material from the lower end of the crushing zone, and a removable wear plate mounted on a mounting face of at least one of said jaws by a wedge arrangement coupled with a power-operated linear actuator which is operative in one direction to pull the wear plate into engagement with the mounting face in order to mount the wear plate on the jaw and which is operative in an opposite direction in order to move the wear plate away from the mounting face and thereby allow the wear plate to be lifted out of the crusher unit when it is required to be replaced.

A jaw crusher unit according to the invention therefore is able to mount a replacement wear plate on a crusher jaw more quickly, than in existing machines using known bolts and wedges. Also, by application of a separating force to the wear plate via the linear actuator and wedge, it can assist in de-mounting of a wear plate even when there is crushed material jamming the wear plate in position.

Preferably, the removable wear plate is mounted on the fixed jaw. However, as an alternative, or in addition, the same wear-plate mounting and de-mounting arrangement may be provided for the movable jaw.

The power operated linear actuator may comprise any suitable device which can apply a linear force to the wear plate (a pulling force in the case of mounting a replacement wear plate in position, and a pushing force in the case of de-mounting a worn plate). Preferably, a piston/cylinder device is coupled with a wear plate-securing wedge, and which may be hydraulically or pneumatically operable. However, it is within the scope of the invention to use other types of power operated linear actuator, such as an externally threaded rotary spindle and follower.

A preferred embodiment of jaw crusher unit according to the invention will now be described in detail, by way of example only, with reference to the accompanying drawing, in which.

Figure 1:
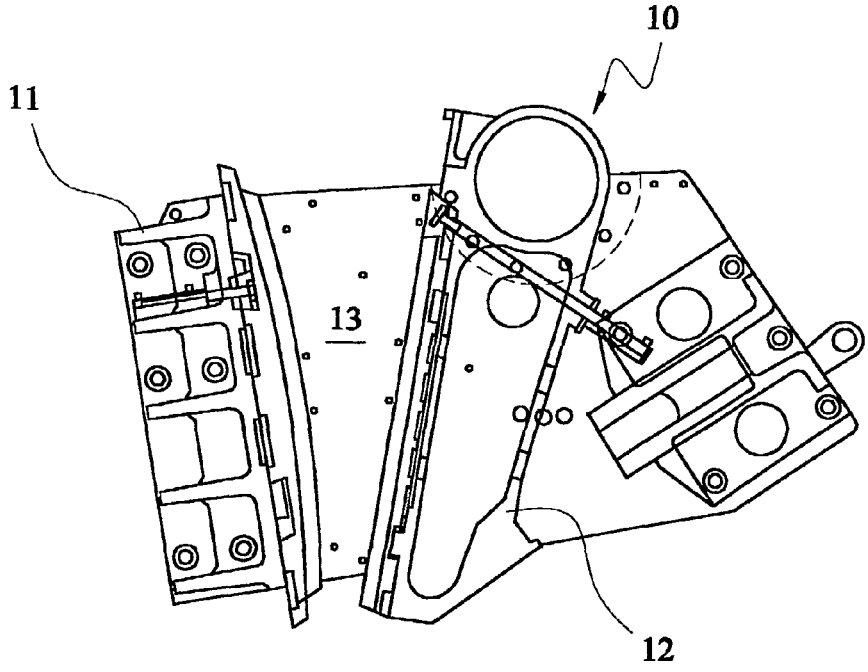
FIG. 1 is a side view of a jaw crusher unit to which the invention may be applied.

Referring now to the drawings, a jaw crusher unit according to the invention is designated generally by reference 10, and is intended for use in crushing stone and other crushable material, comprising a fixed jaw 11 and a movable jaw 12 which define a crushing zone 13 there-between. An eccentric drive mechanism (not shown in detail) is coupled with the movable jaw 12 and is operative to rock the movable jaw 12 to and fro in order to crush material in the crushing zone. A link mechanism (not shown) is connected to a lower end of the movable jaw 12 and serves to set any required space between the lower end of the movable jaw 12 and the fixed jaw 11 and thereby control the discharge of crushed material from the lower end of the crushing zone 13.

It is usual to provide de-mountable wear plates on both the fixed jaw 11 and the movable jaw 12, and when they become excessively worn, they must be de-mounted, and replacement wear plates mounted in their position.

Figure 2:
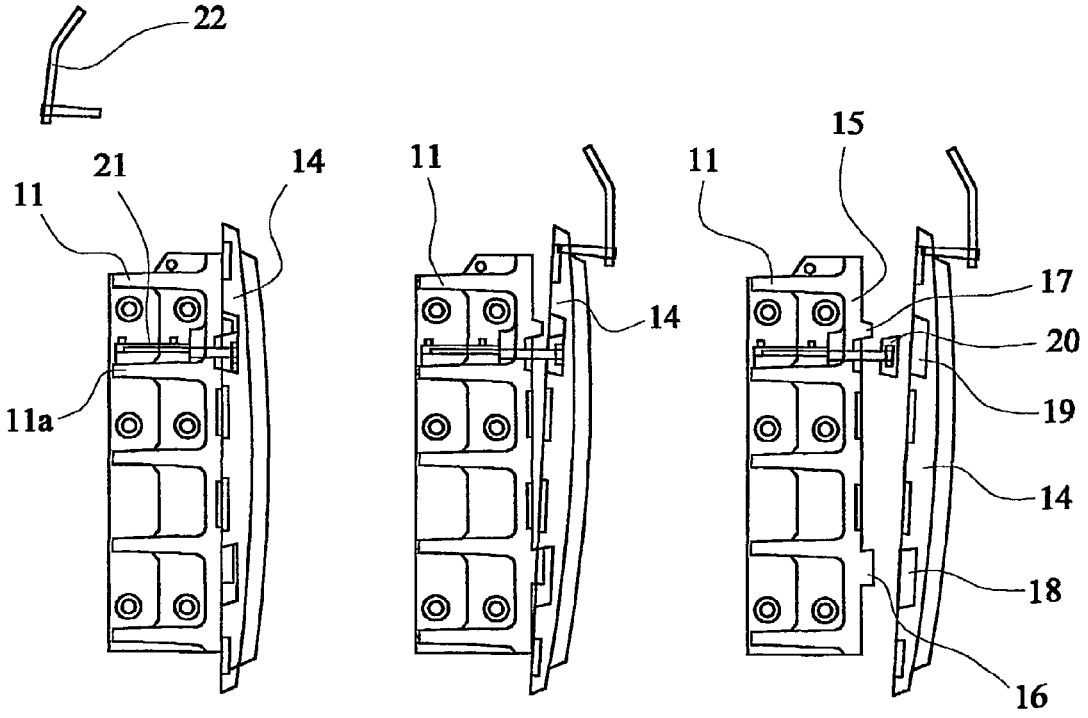
FIG. 2 illustrates successive stages in the removal, and mounting of a wear plate on a fixed jaw of the crusher unit shown in FIG. 1.

FIG. 2 shows successive stages in the mounting, and de-mounting of a removable wear plate 14 relative to the fixed jaw 11. Therefore the jaw 11 has a forward mounting face 15 on which wear plate 14 can be mounted, and it will be noted from the right hand illustration of FIG. 2 in particular that the mounting face 15 includes projections 16 and 17 which can inter-fit snuggly in matching recesses 18 and 19 in the rear face of the wear plate 14. The left hand illustration of FIG. 2 shows snug inter-fit between the projections 16 and 17, and the recesses 18 and 19.

A linearly displaceable wedge 20 is mounted in an upper portion 11*a* of the fixed jaw 11, being carried at one end of a (power operated) linearly displaceable actuator 21. The series of illustrations in FIG. 2 show successive stages in mounting, and de-mounting wear plate 14. Evidently, the actuator 21 will be operated in one direction in order to pull the wear plate 14 into engagement with the mounting face 15 (see the middle illustration) in order to mount the wear plate on the jaw 11. However, it is operative in an opposite direction, in order to move i.e. push the wear plate 14 away from the mounting face 15 and thereby allow the wear plate 14 to be lifted out of the crusher unit 10 when the wear plate is required to be replaced.

Reference 22 illustrates schematically use of a lifting tool which can hook into engagement with an upper end of the wear plate 14, both for mounting and de-mounting purposes.

Any suitable power operated linear actuator device may be provided to function as actuator 21, though preferred means is a piston/cylinder unit, preferably hydraulically operated. Evidently, a substantial separating force can be applied to the rear face of the wear plate 14, when it is required to be removed, and the application of such a strong force can easily overcome any jamming of the wear plate which may occur in practice, due to the presence of crushed material tightly trapped alongside the wear plate i.e. between the sides of the wear plate and the sides of the crusher unit.

It is particularly preferred to provide a wedge arrangement coupled with a power operated linear actuator for mounting and de-mounting a wear plate on the fixed jaw (11) of a crusher unit. However, as an alternative, or in addition, a similar mounting and de-mounting arrangement may be provided for a movable jaw of a crusher unit. However, it is particularly suitable for the fixed jaw 11, where there is greater risk of the wear plate becoming jammed in position in service.

Figure 3:
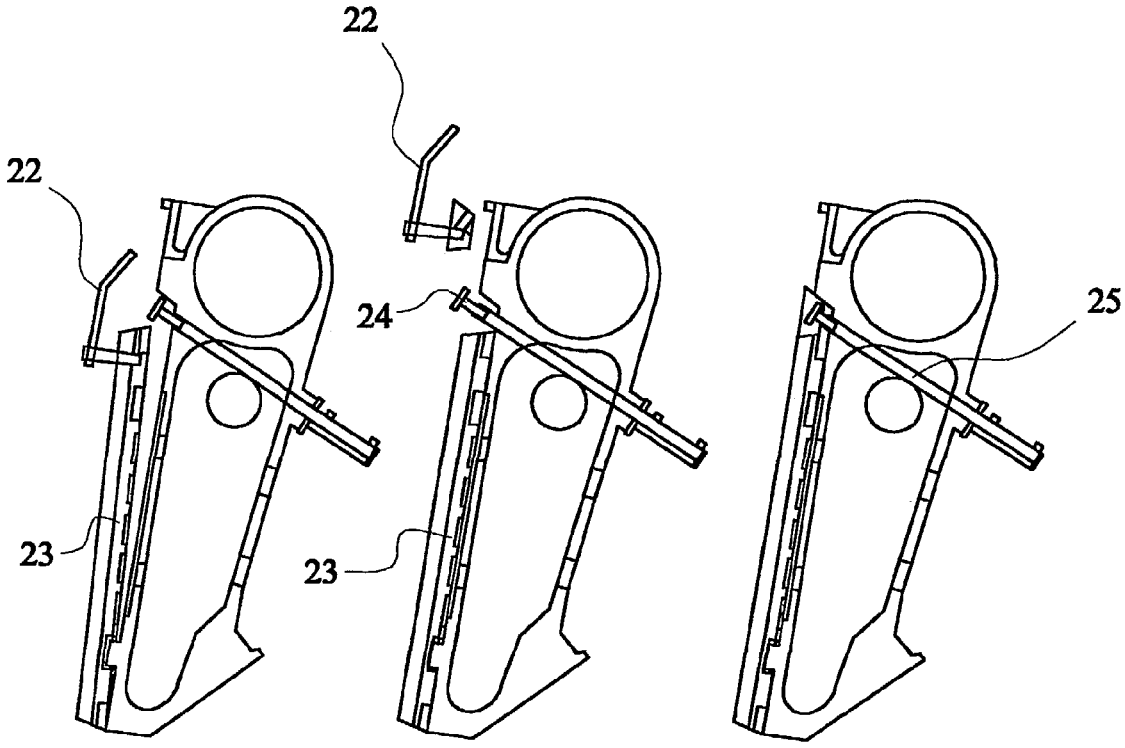
FIG. 3 shows successive stages in the mounting, and de-mounting, of a removable wear plate on a movable jaw of the crusher unit shown in FIG. 1.

FIG. 3 shows a different type of mounting and de-mounting arrangement for removable wear plate 23. A wedge 24 is carried on one end of a rod 25, and by suitable manual or other manipulation, wedge 24 can move towards the mounting face of the jaw 12, to the position shown in the right hand illustration of FIG. 3, and in order to mount the wear plate 23 on the mounting face. FIG. 3 also shows use of lifting tool 22 for the purposes of mounting and de-mounting the wear plate 23.

What is claimed is:

1. A jaw crusher unit for use in crushing stone and other crushable material and comprising:

a fixed jaw and a moveable jaw which define a crushing zone therebetween, a drive mechanism coupled with the moveable jaw and operative to rock the moveable jaw to and fro in order to crush material in the crushing zone, a link mechanism connected to a lower end of the moveable jaw and serving to set any required space between the lower end of the moveable jaw and the fixed jaw and thereby control the discharge of crushed material from the lower end of the crushing zone, and a removable wear plate mounted on a mounting face of at least one of said jaws by a wedge arrangement coupled with a power-operated linear actuator which is operative in one direction to pull the wear plate into engagement with the mounting face in order to mount the wear plate on the jaw and which is operative in an opposite direction in order to move the wear plate away from the mounting face and thereby allow the wear plate to be lifted out of the crusher unit when it is required to be replaced.

2. A jaw crusher unit according to claim 1, in which the removable wear plate is mounted on the fixed jaw.

3. A jaw crusher unit according to claim 2, in which a removable wear plate is mounted on the movable jaw, and is retained in position by a wedge carried on one end of a rod which is manipulatable, in order to mount of de-mount the wear plate relative to the mounting face of the moveable jaw.

4. A jaw crusher unit according to claim 2, in which the power operated linear actuator comprises a device which can apply a linear force to the wear plate which generates a pulling force in the case of mounting a replacement wear plate in position, and a pushing force in the case of de-mounting a worn plate.

5. A jaw crusher unit according to claim 4, in which the linear actuator comprises a piston/cylinder device which is coupled with a wear plate/securing wedge, and which is hydraulically or pneumatically operable.

6. A jaw crusher unit according to claim 5, including a lifting tool engageable with a wear plate, for the purposes of mounting and demounting the wear plate relative to the corresponding jaw.

7. A jaw crusher unit according to claim 1, in which the removable wear plate is mounted on the movable jaw.

8. A jaw crusher unit according to claim 7, in which the power operated linear actuator comprises an externally threaded rotary spindle and follower.

9. A jaw crusher unit according to claim 7, in which the power operated linear actuator comprises a device which can apply a linear force to the wear plate which generates a pulling force in the case of mounting a replacement wear plate in position, and a pushing force in the case of demounting a worn plate.

10. A jaw crusher unit according to claim 9, in which the linear actuator comprises a piston/cylinder device which is coupled with a wear plate/securing wedge, and which is hydraulically or pneumatically operable.

11. A jaw crusher unit according to claim 10, including a lifting tool engageable with a wear plate, for the purposes of mounting and demounting the wear plate relative to the corresponding jaw.

12. A jaw crusher unit according to claim 1, in which the power operated linear actuator comprises a device which can apply a linear force to the wear plate which generates a pulling force in the case of mounting a replacement wear plate in position, and a pushing force in the case of demounting a worn plate.

13. A jaw crusher unit according to claim 12, in which the linear actuator comprises a piston/cylinder device which is coupled with a wear plate/securing wedge, and which is hydraulically or pneumatically operable.

14. A jaw crusher unit according to claim 1, including a lifting tool engageable with a wear plate, for the purposes of mounting and demounting the wear plate relative to the corresponding jaw.

* * * * *